US006837283B1

(12) United States Patent
Wegner

(10) Patent No.: US 6,837,283 B1
(45) Date of Patent: Jan. 4, 2005

(54) FILL CAP HAVING CONTAINED EXTENSION AND FUNNEL

(76) Inventor: Chad A. D. Wegner, 7 Briar Place, Strathmore, AB (CA), T1P 1E6

( * ) Notice: Subject to any disclaimer, the term of this patent is extended or adjusted under 35 U.S.C. 154(b) by 0 days.

(21) Appl. No.: 10/798,591

(22) Filed: Mar. 12, 2004

(51) Int. Cl.[7] ..... B65B 1/04
(52) U.S. Cl. ..... 141/338; 141/98; 220/86.2
(58) Field of Search ..... 141/331–345, 141/98, 114; 220/86.1, 86.2, DIG. 33

(56) References Cited

U.S. PATENT DOCUMENTS 1,510,631 A * 10/1924 Nutry ..... 141/338
5,188,157 A * 2/1993 Lee ..... 141/338
6,223,793 B1 * 5/2001 Donoughe et al. ..... 14/338
6,397,907 B1 * 6/2002 Heintz ..... 141/338

* cited by examiner

*Primary Examiner*—Steven O. Douglas
(74) *Attorney, Agent, or Firm*—G. F. Gallinger

(57) ABSTRACT

Pouring fluid without spilling from a container having a top opening into a fill hole in mechanical equipment is difficult because one can't position the top opening adjacent to the fill hole. A fill cap having a contained extension comprises: a) a base having a lower portion having an external diameter sized to snugly and securely mate within the fill hole; b) an upper head having an upper portion thereof having an external peripheral surface adapted to be gripped and twisted, and a lower portion thereof having a thread configured to mate with the threaded top opening in the base; and, c) a plurality of neck segments, each having a tapered top portion adapted to mate within an opening immediately thereabove, and a smaller rounded tapered bottom portion, said neck segments assembled between the upper head and the base so that when the upper head is unscrewed from within the base, and then pulled, the upper head is solidly and peripherally continuously connected by the neck segments to the base.

14 Claims, 1 Drawing Sheet

FILL CAP HAVING CONTAINED EXTENSION AND FUNNEL

FIELD OF THE INVENTION

Figure 1:
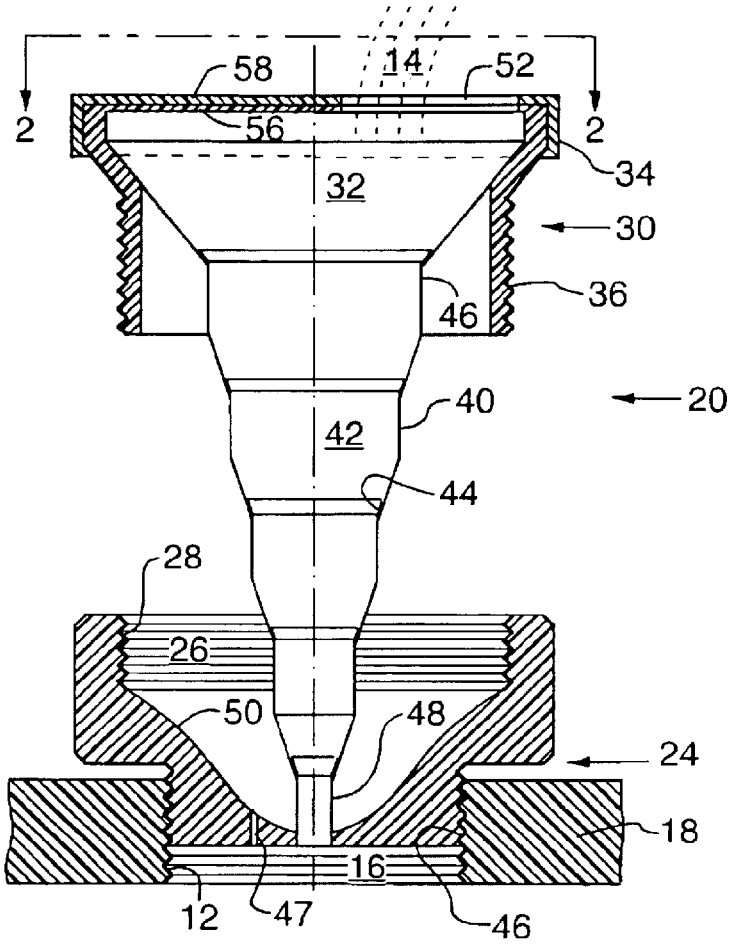

This invention relates to caps on engines and other equipment which are removable to add fluids either to maintain proper levels between scheduled maintenance or to replace the fluids during scheduled maintenance. More particularly this invention relates to a removable fluid cap which houses and stores an extension and funnel.

BACKGROUND OF THE INVENTION

Most vehicle engines and transmissions have oil caps which are mounted on a top surface. Most frequently these caps are removable from what is effectively a generally horizontal surface. In most modern vehicle engines there is no uncluttered dropping side of the engine adjacent to the oil fill hole which can accommodate receiving a quart container of oil so that the top opening on the quart container of oil can be positioner immediately adjacent to the oil fill hole before the quart of oil is tipped to guide and pour a stream of oil from the container into the fill hole.

Oil cannot be poured with an acceptable level of accuracy from a quart container into a fill hole unless the target fill hole can be positioned immediately adjacent to the top opening on the quart of oil. The poured oil projects laterally first a little bit and then a multiple of its initial distance. Almost as soon as one has laterally moved back the quart container from the fill hole to allow the laterally projecting stream of oil to drop into the hole the flow diminishes and temporarily almost stops to allow air to be sucked into the quart container. As air replaces the oil poured from the container one moves the container closer to the fill hole so that the partial stream falls into the target hole. After air has replaced the oil poured from the quart container, the stream of oil then temporarily gushes out with even greater velocity and lateral projection entirely overshooting the fill hole from the container which was moved laterally closer to the fill hole to accommodate the diminished stream. Flow velocity from a quart container of oil is unpredictably erratic as replacement air irregularly cycles into the quart container through the top opening. What is needed is a funnel and extension so that the top opening of the quart container can be positioned immediately adjacent tot the fill hole.

OBJECTS OF THE INVENTION

It is an object of this invention to disclose a convenient apparatus to facilitate adding fluids to vehicles and mechanical equipment. It is an object of this invention to disclose a fill cap having a contained extension and funnel. The funnel and extension are stored in the fill cap so that they are conveniently available and positioned when the fill cap is removed. When the fill cap is closed the extension and funnel are automatically stored and ready for a subsequent use. They need not even be wiped clean. The housing encloses the funnel and extension away from dust and so that any run off drips into the fill hole. It is yet a further object of this invention to disclose an apparatus which will eliminate fluid spills onto and beneath an engine and other mechanical equipment.

One aspect of this invention provides for an extendable fill cap having a contained extension for use with mechanical equipment having a fluid fill hole which comprises: a) a base having a lower portion having an external diameter sized to snugly and securely mate within the fill hole on the mechanical equipment, said base also having a top opening having a thread therearound; b) an upper head having a round longitudinal central opening therethrough, an upper portion thereof having an external peripheral surface adapted to be gripped and twisted, and a lower portion thereof having a thread configured to mate with the threaded top opening in the base; and, c) a plurality of neck segments, each neck segment also having a round interior opening therethrough and having a tapered top portion adapted to mate within an opening immediately thereabove, and each having a smaller rounded tapered bottom portion; said neck segments including an upper most neck segment having a top peripheral portion sized to closely and centrally fit within the upper head, and including a lower most neck segment having a bottom portion sized to closely and centrally extend through the base, said neck segments assembled between the upper head and the base so that when the upper head is unscrewed from within the base, and then pulled, the upper head is solidly and peripherally continuously connected by the neck segments to the base. Wherein use when the base is snugly and securely mated within the fill hole, the upper head is unscrewed from the base and pulled, then fluid poured into the upper head will be conveyed to the fill hole.

In a preferred aspect of this apparatus the threads on the top portion of the base are on an internal side portion of the top opening, and the mating threads on the upper head are external threads on an external side of the lower portion. Additionally, an upper portion of the base has a larger diameter than the lower of the base to accommodate and house neck segments which have a diameter exceeding the diameter of the lower portion of the base.

Various other objects, advantages and features of this invention will become apparent to those skilled in the art from the following description in conjunction with the accompanying drawings.

FIGURES OF THE INVENTION

FIG. 1 is a cross sectional view of an extendible fill cap in an extended position.

Figure 2:
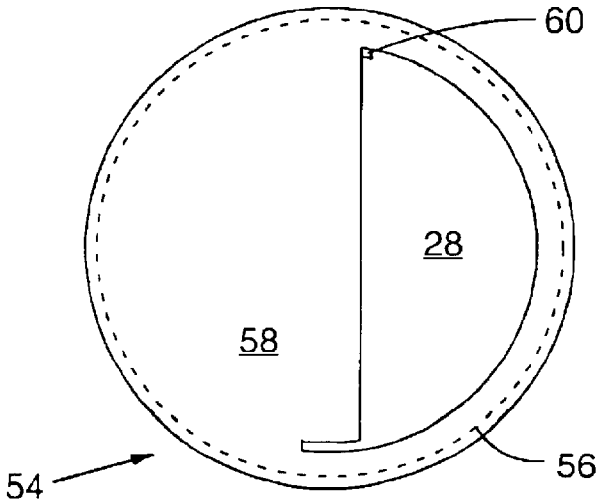

FIG. 2 is a reduced plan view of a preferred embodiment of the invention taken along line 2—2 on FIG. 1. FIG. 2 shows a semicircular top opening 52 which is opened or closed when the upper head 30 of the extendible fill cap 20 is twisted with respect to the base 24.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a cross sectional view of an extendible fill cap 20 in an extended position. Most generally, the fill cap having a contained extension 22 is for use with mechanical equipment 18 having a fluid fill hole 16, comprises: a) a base 24 having a lower portion having an external diameter sized to snugly and securely mate within the fill hole 16 on the mechanical equipment 18, said base 24 also having a top opening 26 having a thread 28 therearound; b) an upper head 30 having a round longitudinal central opening 32 therethrough, an upper portion thereof having an external peripheral surface 34 adapted to be gripped and twisted, and a lower portion thereof having a thread 36 configured to mate with the thread 28 in the base; and, c) a plurality of neck segments 40, each neck segment 40 also having a round interior opening 42 therethrough and having a tapered 44 top portion adapted to mate within an opening immediately thereabove, and each having a smaller rounded tapered bottom portion; said neck segments 40 including an upper most neck segment 46 having a top peripheral portion sized to closely and centrally fit within the upper head 30, and including a lower most neck segment 48 having a bottom portion sized to closely and centrally extend through the base 34, said neck segments 40 assembled between the upper head 30 and the base 24 so that when the upper head 30 is unscrewed from within the base 24, and then pulled, the upper head 30 is solidly and peripherally continuously connected by the neck segments to the base 24. When the base 24 is snugly and securely mated within the fill hole 16, and after the upper head 30 is unscrewed from the base 24 and pulled, then fluid 14 poured into the upper head 34 will be conveyed to the fill hole 16.

In most applications the fill hole 16 on the mechanical equipment has a threaded internal side portion 12 and the lower portion of the base 24 can thereby be provided with a mating external thread 46. In the most preferred aspect of this invention the extendable fill cap 20 has threads 28 on the top portion of the base 30 on an internal side portion of the top opening 26, and the mating threads 36 on the upper head 30 are external threads on an external side of the lower portion thereof.

Most preferably, a lower interior portion of the base 24 has a drain hole 46 and where the interior portion 50 of the base 24 is sloped to drain fluid 44 caught therein through the drain hole 47. In the most preferred aspect of this invention an upper portion of the base 24 has a larger diameter than the lower of the base to accommodate and house neck segments 40 which have a diameter exceeding the diameter of the lower portion of the base 24.

FIG. 2 is a reduced plan view taken along line 2—2 on FIG. 1. FIG. 2 shows a preferred embodiment of the invention having a semicircular top opening 52 which is opened or closed when the upper head 30 of the extendible fill cap 20 is twisted with respect to the base 24. In almost all applications of the invention, an inner head cover 54 is provided to isolated fluid 14 in the extendable fill cap 20 from ambient air and contaminants therein. In the most preferred aspect of this invention the cover 54 comprises an attached disc 56 peripherally attached to and extending across the round opening 32 in a top portion of the upper head 30, said attached disc 56 having a semi-circular opening 52 therethrough, and a second movable disc 58 seated on and around the top portion of the upper head 30, said moveable disc 58 also having a similarly sized semi-circular opening 52 therethrough, and said moveable disc 58 configured with a stop 60 so that when the upper head 30 is twisted in a counter clockwise direction the semicircular openings 52 are aligned, and when the top portion of the upper head 30 is twisted in a clockwise direction the moveable disc 58 rotates above the attached disc 56 until the moveable disc 58 covers the opening 52 through the attached disc 56.

A general method of filling a mechanical equipment 18 with fluid 14 through a fill hole 16 comprises the following steps: providing a fill cap 20 as most generally described above; inserting the base 24 snugly and securely mated within the fill hole 16; unscrewing the upper head 30 from the base 24; pulling the upper head 30 to continuously assemble the neck segments 40; and, pouring fluid 14 into the upper head 30 to thereby be conveyed to the fill hole 16. This general method can be limited by providing a more specific extendable fill cap 20 as described above.

While the invention has been described with preferred specific embodiments thereof, it will be understood that this description is intended to illustrate and not to limit the scope of the invention, which is defined by the following claims.

I claim:

1. An extendable fill cap having a contained extension for use with mechanical equipment having a fluid fill hole comprising:

a) a base having a lower portion having an external diameter sized to snugly and securely mate within the fill hole on the mechanical equipment, said base also having a top opening having a thread therearound;

b) an upper head having a round longitudinal central opening therethrough, an upper portion thereof having an external peripheral surface adapted to be gripped and twisted, and a lower portion thereof having a thread configured to mate with the threaded top opening in the base; and, c) a plurality of neck segments, each neck segment also having a round interior opening therethrough and having a tapered top portion adapted to mate within an opening immediately thereabove, and each having a smaller rounded tapered bottom portion; said neck segments including an upper most neck segment having a top peripheral portion sized to closely and centrally fit within the upper head, and including a lower most neck segment having a bottom portion sized to closely and centrally extend through the base, said neck segments assembled between the upper head and the base so that when the upper head is unscrewed from within the base, and then pulled, the upper head is solidly and peripherally continuously connected by the neck segments to the base;

wherein use when the base is snugly and securely mated within the fill hole, the upper head is unscrewed from the base and pulled, then fluid poured into the upper head will be conveyed to the fill hole.

2. An extendable fill cap as in claim 1 wherein the fill hole on the mechanical equipment is threaded and wherein the lower portion of the base has a mating threaded external thread.

3. An extendable fill cap as in claim 2 wherein threads on the top portion of the base are on an internal side portion of the top opening, and wherein the mating threads on the upper head are external threads on an external side of the lower portion.

4. An extendable fill cap as in claim 3 wherein a lower interior portion of the base has a drain hole and the interior portion of the base is sloped in order to drain fluid caught therein through the drain hole.

5. An extendable fill cap as in claim 3 wherein an upper portion of the base has a larger diameter than the lower of the base to accommodate and house neck segments which have a diameter exceeding the diameter of the lower portion of the base.

6. An extendable fill cap as in claim 5 further comprising an upper head cover so that when the upper head is screwed into the base the round opening extending through the inner head and the neck segments stored within the base can be isolated from ambient air and contaminants therein.

7. An extendable fill cap as in claim 6 wherein the upper head cover further comprises an attached disc peripherally attached to and extending across the round opening in a top portion of the upper head, said attached disc having a semi-circular opening therethrough, and a second movable disc seated on and around the top portion of the inner head, said moveable disc also having a similarly sized semi-circular opening therethrough, said moveable disc configured with a stop so that when the upper head is twisted in a counter clockwise direction the semicircular openings are aligned, and when the top portion of the upper head is twisted in a clockwise direction the moveable disc rotates above the attached disc until the moveable disc covers the opening through the attached disc.

8. A method of filling a mechanical equipment with fluid through a fill hole comprising the following steps:

providing a fill cap having i) a base having a lower portion having an external diameter sized to snugly and securely mate within the fill hole on the mechanical equipment, said base also having a top opening having a thread therearound; ii) an upper head having a round longitudinal central opening therethrough, an upper portion thereof having an external peripheral surface adapted to be gripped and twisted, and a lower portion thereof having a thread configured to mate with the threaded top opening in the base; and, iii) a plurality of neck segments, each neck segment also having a round interior opening therethrough and having a tapered top portion adapted to mate within an opening immediately thereabove, and each having a smaller rounded tapered bottom portion; said neck segments including an upper most neck segment having a top peripheral portion sized to closely and centrally fit within the inner head, and including a lower most neck segment having a bottom portion sized to closely and centrally extend through the base, said neck segments assembled between the inner head and the base so that when the inner head is unscrewed from within the base, and then pulled, the inner head is solidly and peripherally continuously connected by the neck segments to the base;

inserting the base snugly and securely mated within the fill hole;

unscrewing the upper head from the base;

pulling the upper head to continuously assemble the neck segment; and, pouring fluid into the upper head to thereby be conveyed to the fill hole.

9. A method as in claim 8 wherein the fill hole on the mechanical equipment is threaded and wherein the lower portion of the base has a matingly threaded external diameter; and wherein the step of inserting the base within the fill hole comprises the step of screwing the base into the fill hole.

10. A method as in claim 9 wherein threads on the top portion of the base are on an internal side portion of the top opening, and wherein the mating threads on the upper head are external threads on an external side of the lower portion.

11. A method as in claim 10 wherein a lower interior portion of the base has a drain hole and the interior portion of the base is sloped to drain fluid caught therein through the drain hole.

12. A method as in claim 11 wherein an upper portion of the base has a larger diameter than the lower of the base to accommodate and house neck segments which have a diameter exceeding the diameter of the lower portion of the base.

13. A method as in claim 12 wherein the fill cap further comprises an inner head cover so that when the inner head is screwed into the base the round opening extending through the inner head and the neck segments stored within the base can be isolated from ambient air and contaminants therein; and further comprising the step of removing the cover prior to pouring fluid into the upper head.

14. A method as in claim 13 wherein the inner head cover further comprises an attached disc peripherally attached to and extending across the round opening in a top portion of the upper head, said attached disc having a semi-circular opening therethrough, and a second movable disc seated on and around the top portion of the inner head, said moveable disc also having a similarly sized semi-circular opening therethrough, said moveable disc configured with a stop so that when the upper head is twisted in a counter clockwise direction the semicircular openings are aligned, and when the top portion of the upper head is twisted in a clockwise direction the moveable disc rotates above the attached disc until the moveable disc covers the opening through the attached disc; and further comprising the step of removing the cover prior to pouring fluid into the upper head by twisting the upper portion of the upper head in a counter clockwise direction to align the openings in the discs.

* * * * *